US010632345B2

(12) United States Patent
Inoue et al.

(10) Patent No.: US 10,632,345 B2
(45) Date of Patent: Apr. 28, 2020

(54) GOLF BALL

(71) Applicant: SUMITOMO RUBBER INDUSTRIES, LTD., Kobe-shi, Hyogo (JP)

(72) Inventors: Hidetaka Inoue, Kobe (JP); Kazuya Kamino, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 16/239,131

(22) Filed: Jan. 3, 2019

(65) Prior Publication Data

US 2019/0232117 A1 Aug. 1, 2019

(30) Foreign Application Priority Data

Jan. 29, 2018 (JP) ..... 2018-012251

(51) Int. Cl.
*A63B 37/06* (2006.01)
*A63B 37/00* (2006.01)
*A63B 102/32* (2015.01)

(52) U.S. Cl.
CPC ..... *A63B 37/0092* (2013.01); *A63B 37/0045* (2013.01); *A63B 37/0063* (2013.01); *A63B 37/0096* (2013.01); *A63B 37/0043* (2013.01); *A63B 37/0076* (2013.01); *A63B 2102/32* (2015.10)

(58) Field of Classification Search
CPC ..... A63B 37/0063
USPC ..... 473/373
See application file for complete search history.

(56) References Cited

U.S. PATENT DOCUMENTS

2009/0098951 A1* 4/2009 Sullivan ..... A63B 37/0003 473/377
2014/0148273 A1 5/2014 Michael et al.
2014/0287851 A1 9/2014 Bulpett et al.
2015/0283432 A1* 10/2015 Sullivan ..... A63B 37/0064 473/373
2016/0016048 A1 1/2016 Sullivan et al.

FOREIGN PATENT DOCUMENTS

JP 6027563 B2 11/2016
JP 3208065 U 12/2016

* cited by examiner

*Primary Examiner* — Raeann Gorden
(74) *Attorney, Agent, or Firm* — Birch, Stewart, Kolasch & Birch, LLP

(57) ABSTRACT

A golf ball includes a spherical core and a cover positioned outside the core. The core has an inner layer and an outer layer positioned outside the inner layer. The inner layer is obtained by crosslinking a rubber composition. The rubber composition of the inner layer includes a butyl-based rubber as a base rubber. The inner layer has a diameter Di of not less than 10 mm and not greater than 34 mm. A difference (H2−H0) between a Shore C hardness H2 at a surface of the outer layer and a Shore C hardness H0 at a central point of the inner layer is less than 35. Preferably, the butyl-based rubber is a polymer including an isobutylene unit and an isoprene unit, and a derivative thereof.

19 Claims, 1 Drawing Sheet

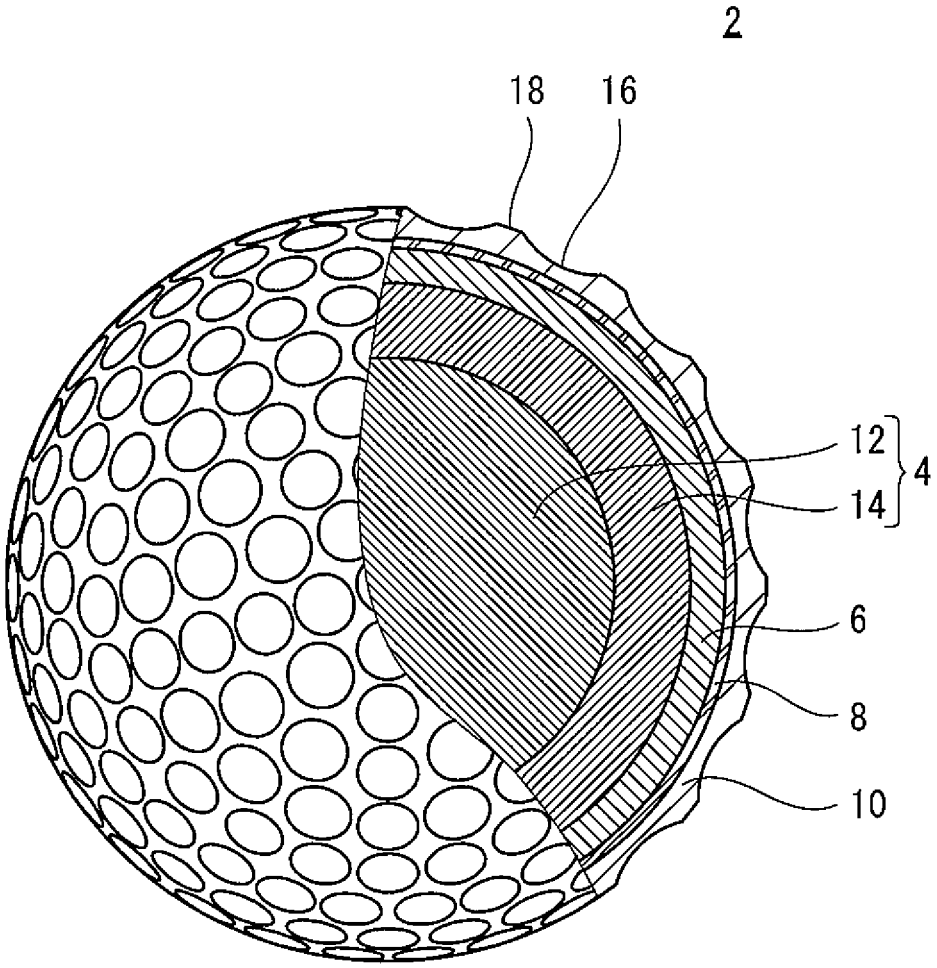
2
18
16
12
14
4
6
8
10

GOLF BALL

This application claims priority on Patent Application No. 2018-12251 filed in JAPAN on Jan. 29, 2018. The entire contents of this Japanese Patent Application are hereby incorporated by reference.

BACKGROUND OF THE INVENTION

Field of the Invention

The present invention relates to golf balls. Specifically, the present invention relates to golf balls including a core.

Description of the Related Art

The greatest interest to golf players concerning golf balls is flight performance. The flight distance of a golf ball achieved when the golf ball is hit with a golf club mainly correlates to resilience performance of a core. When a golf ball in which a core having high resilience performance is used is hit, the golf ball flies at a high speed, and a large flight distance is achieved. An appropriate trajectory height is required in order to achieve a large flight distance. A trajectory height depends on a spin rate and a launch angle. With a golf ball that achieves a high trajectory by a low spin rate and a high launch angle, a large flight distance is achieved.

There have been various proposals for improvement of cores in light of flight distance and spin rate. Japanese Utility Model Registration No. 3208065 discloses a golf ball including a core that has an inner core layer formed from a rubber composition and an outer core layer formed from a thermoplastic composition. US2009/0098951 proposes a technique to control the resilience coefficient, the weight, the aerodynamic characteristics, and the like of a golf ball including a core formed from a rubber composition, thereby reducing a flight distance with various performance characteristics maintained. US2015/0283432 discloses a golf ball that includes an inner core layer formed from an unfoamed thermosetting or thermoplastic composition and an outer core layer formed from a foamed composition.

JP6027563 discloses a golf ball having a layer formed from a heterogeneous composition. The heterogeneous composition includes: a matrix formed from a thermosetting polymer composition that does not include a crosslinking agent; and individual particles that are dispersed in the matrix and formed from a crosslinked rubber composition. US2014/148273 proposes a golf ball having a multilayer core that includes an inner layer core, a mid core, and an outer layer core. In the multilayer core, the specific gravity, the thickness, and the hardness gradient of each layer are specified.

In play, a spin rate and a flight distance vary due to various factors upon a shot. In particular, in play by beginners, a hitting point and an effective loft angle at which a ball is hit by a clubface are unstable. The instability of the hitting point and the effective loft angle causes great variations in spin rate and flight distance. When variations in spin rate and flight distance are great, it is difficult for a golf player to cause a golf ball to land on a target spot. A golf ball, in which a spin rate and a flight distance are unlikely to be influenced by a hitting point and an effective loft angle of a clubface, is desired. In particular, golf players place importance on spin rate stability and flight distance stability upon a shot with a middle iron, which has a great effect on scoring.

For golf players, feel at impact of golf balls is also important. Golf players prefer a soft feel at impact upon shots with drivers. In addition, golf players are also interested in durability of golf balls. A golf ball becomes deformed by great shock when being hit with a driver or the like. Due to a local load by the deformation, the golf ball may be broken. A golf ball that is not durable to deformation due to hitting is difficult to use continuously over a long period of time.

An object of the present invention is to provide a golf ball that has excellent spin rate stability and excellent flight distance stability upon a shot with a middle iron and has high durability and favorable feel at impact upon a shot with a driver.

SUMMARY OF THE INVENTION

A golf ball according to the present invention includes a spherical core and a cover positioned outside the core. The core has an inner layer and an outer layer positioned outside the inner layer. The inner layer is obtained by crosslinking a rubber composition. The rubber composition of the inner layer includes a butyl-based rubber as a base rubber. The inner layer has a diameter Di of not less than 10 mm and not greater than 34 mm. A difference (H2−H0) between a Shore C hardness H2 at a surface of the outer layer and a Shore C hardness H0 at a central point of the inner layer is less than 35.

The golf ball according to the present invention has the inner layer that is formed from a rubber composition including a butyl-based rubber as a base rubber and that has an appropriate size. The inner layer absorbs shock received by the golf ball when the golf ball is hit, thereby reducing entire deformation of the golf ball caused at the time of hitting. With the golf ball, even when a hitting point and an effective loft angle are varied every shot, the influence on a deformation state of the entire ball is small, so that a stable spin rate and a stable flight distance are achieved. The golf ball has excellent spin rate stability and excellent flight distance stability. In addition, with the golf ball, soft feel at impact is obtained due to the inner layer having shock absorbing performance. Furthermore, with the golf ball, high durability is achieved due to an appropriate hardness distribution of the core.

Preferably, the butyl-based rubber is a polymer including an isobutylene unit and an isoprene unit, and a derivative thereof. Preferably, a proportion of the butyl-based rubber to the entire base rubber is not less than 1% by weight and not greater than 40% by weight.

Preferably, the outer layer is obtained by crosslinking a rubber composition. Preferably, the outer layer has a thickness To of not less than 4 mm and not greater than 15 mm.

Preferably, the inner layer has a specific gravity di of not less than 1.05 and not greater than 1.20.

Preferably, the outer layer has a specific gravity do of not less than 1.05 and not greater than 1.20.

Preferably, the hardness H2 is greater than a Shore C hardness H1 at a surface of the inner layer.

Preferably, the golf ball further includes a mid layer between the core and the cover.

BRIEF DESCRIPTION OF THE DRAWINGS

FIG. 1 is a partially cutaway cross-sectional view of a golf ball according to one embodiment of the present invention.

DESCRIPTION OF THE PREFERRED EMBODIMENTS

The following will describe in detail the present invention based on preferred embodiments with appropriate reference to the drawings.

A golf ball 2 shown in FIG. 1 includes a spherical core 4, a mid layer 6 positioned outside the core 4, a reinforcing layer 8 positioned outside the mid layer 6, and a cover 10 positioned outside the reinforcing layer 8. The core 4 has a spherical inner layer 12 and an outer layer 14 positioned outside the inner layer 12. On the surface of the cover 10, a large number of dimples 16 are formed. Of the surface of the golf ball 2, a part other than the dimples 16 is a land 18. The golf ball 2 includes a paint layer and a mark layer on the external side of the cover 10, but these layers are not shown in the drawing.

The golf ball 2 has a diameter of not less than 40 mm and not greater than 45 mm. From the viewpoint of conformity to the rules established by the United States Golf Association (USGA), the diameter is preferably not less than 42.67 mm. In light of suppression of air resistance, the diameter is preferably not greater than 44 mm and more preferably not greater than 42.80 mm. The golf ball 2 has a weight of not less than 40 g and not greater than 50 g. In light of attainment of great inertia, the weight is preferably not less than 44 g and more preferably not less than 45.00 g. From the viewpoint of conformity to the rules established by the USGA, the weight is preferably not greater than 45.93 g.

The inner layer 12 is obtained by crosslinking a rubber composition. The rubber composition of the inner layer 12 includes a butyl-based rubber as a base rubber. The butyl-based rubber can contribute to shock absorbing performance of the inner layer 12. When the golf ball 2 that includes the inner layer 12 is hit with a golf club, the inner layer 12 absorbs shock received by the golf ball 2, thereby reducing entire deformation of the golf ball 2 at the time of hitting. With the golf ball 2, even when a hitting point and an effective loft angle are varied every shot, the degree of variation in a deformation state of the entire ball is low. With the golf ball 2, the influence of variations in hitting point and effective loft angle on spin rate and flight distance is small. The golf ball 2 has excellent spin rate stability and excellent flight distance stability. In addition, when the golf ball 2 that includes the inner layer 12 having shock absorbing performance is hit with a driver or the like, the feel at impact is soft.

In the present specification, the butyl-based rubber means a polymer including an isobutylene unit as a repeat unit, and a derivative thereof. The type of the butyl-based rubber is not particularly limited unless the advantageous effects of the present invention are impaired. Examples of the butyl-based rubber include polyisobutylenes, which are polymers of isobutylene, copolymers of isobutylene and isoprene and derivatives thereof, and copolymers of isobutylene and p-methylstyrene and derivatives thereof. Two or more butyl-based rubbers may be used in combination.

The butyl-based rubber may include another or two or more other repeat units in addition to the isobutylene unit. In light of shock absorbing performance and resilience performance, preferable butyl-based rubbers are a polymer including an isobutylene unit and an isoprene unit as repeat units and a derivative thereof. Examples of such butyl-based rubbers include butyl rubber (IIR) and halogenated butyl rubbers such as chlorinated butyl rubber (CIIR), brominated butyl rubber (BIIR), and the like.

When a butyl-based rubber including an isobutylene unit and an isoprene unit as repeat units is used, the proportion of the isoprene unit in the butyl-based rubber (degree of unsaturation) is preferably not less than 0.6 mol % and more preferably not less than 1.0 mol % in light of resilience performance, and is preferably not greater than 3.2 mol % and more preferably not greater than 2.8 mol % in light of shock absorbing performance.

When a halogenated butyl rubber is used as the butyl-based rubber, the halogen that is a substituent can contribute to progress of a crosslinking reaction. In light of resilience performance, the halogen content of the halogenated butyl rubber is preferably not less than 0.6% by weight and more preferably not less than 1.0% by weight. In light of shock absorbing performance, the halogen content is preferably not greater than 3.0% by weight. The halogen content is measured by a solution NMR method.

The Mooney viscosity (ML1+8, 125° C.) of the butyl-based rubber is preferably not less than 28 and more preferably not less than 30. The Mooney viscosity (ML1+8, 125° C.) is preferably not greater than 60. The Mooney viscosity (ML1+8, 125° C.) of the butyl-based rubber is measured according to the standards of JIS K6300-1. The measurement conditions are as follows.

Rotor: L rotor
Preheating time: 1 minute
Rotating time of rotor: 8 minutes
Temperature: 125° C.

The rubber composition of the inner layer 12 can include another rubber component as a base rubber together with the butyl-based rubber unless the advantageous effects of the present invention are impaired. Examples of the other rubber component include natural rubber (NR), isoprene rubber (IR), butadiene rubber (BR), styrene-butadiene rubber (SBR), styrene-isoprene-butadiene rubber (SIBR), ethylene-propylene-diene rubber (EPDM), nitrile rubber (NBR), chloroprene rubber (CR), styrene-isoprene rubber, and butadiene-isoprene rubber. As the other rubber component, two or more types of rubbers may be used in combination.

In light of stability of spin rate and flight distance, the proportion of the butyl-based rubber to the entire base rubber is preferably not less than 1% by weight, more preferably not less than 5% by weight, and particularly preferably not less than 10% by weight. In light of resilience performance, this proportion is preferably not greater than 40% by weight and more preferably not greater than 35% by weight.

In light of resilience performance and mixability, another rubber component to be used in combination with the butyl-based rubber is preferably a butadiene rubber. The proportion of cis-1,4 bonds in the butadiene rubber is preferably not less than 40% and more preferably not less than 80%. The proportion of the butadiene rubber to the entire base rubber is preferably not less than 40% by weight and more preferably not less than 50% by weight. The proportion of the butadiene rubber is preferably not greater than 60% by weight.

The rubber composition of the inner layer 12 preferably includes a co-crosslinking agent. The co-crosslinking agent achieves high resilience of the inner layer 12. Preferable co-crosslinking agents in light of resilience performance are monovalent or bivalent metal salts of an $\alpha,\beta$-unsaturated carboxylic acid having 2 to 8 carbon atoms. Specific examples of preferable co-crosslinking agents include zinc acrylate, magnesium acrylate, zinc methacrylate, and magnesium methacrylate. In light of resilience performance, zinc acrylate and zinc methacrylate are preferable.

In light of resilience performance, the amount of the co-crosslinking agent per 100 parts by weight of the base rubber is preferably not less than 5 parts by weight, more preferably not less than 10 parts by weight, and particularly preferably not less than 15 parts by weight. In light of stability of spin rate and flight distance and feel at impact, the amount of the co-crosslinking agent is preferably not greater than 45 parts by weight, more preferably not greater than 40 parts by weight, and particularly preferably not greater than 30 parts by weight.

The rubber composition of the inner layer 12 may include a metal oxide and an α,β-unsaturated carboxylic acid having 2 to 8 carbon atoms. They both react with each other in the rubber composition to obtain a salt. The salt serves as a co-crosslinking agent. Examples of preferable α,β-unsaturated carboxylic acids include acrylic acid and methacrylic acid. Examples of preferable metal oxides include zinc oxide and magnesium oxide.

Preferably, the rubber composition of the inner layer 12 includes an organic peroxide. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. An organic peroxide with particularly high versatility is dicumyl peroxide.

The amount of the organic peroxide is adjusted as appropriate in accordance with the type of organic peroxide to be selected. In light of resilience performance, the amount of the organic peroxide per 100 parts by weight of the base rubber is preferably not less than 0.1 parts by weight, more preferably not less than 0.2 parts by weight, and particularly preferably not less than 0.3 parts by weight. In light of stability of spin rate and flight distance and feel at impact, the amount of the organic peroxide is preferably not greater than 3.0 parts by weight, more preferably not greater than 2.5 parts by weight, and particularly preferably not greater than 2.0 parts by weight.

The rubber composition of the inner layer 12 may include a crosslinking activator. Examples of the crosslinking activator include sulfenamide type, thiazole type, thiuram type, thiourea type, guanidine type, dithiocarbamate type, aldehyde-amine type, aldehyde-ammonia type, imidazoline type, xanthate type, and quinone dioxime compounds. One crosslinking activator may be used solely, or two or more crosslinking activators may be used in combination.

The amount of the crosslinking activator is adjusted as appropriate in accordance with the type of crosslinking activator to be selected. In light of resilience performance, the amount of the crosslinking activator per 100 parts by weight of the base rubber is preferably not less than 1.0 part by weight and more preferably not less than 3.0 parts by weight. In light of stability of spin rate and flight distance and feel at impact, the amount of the crosslinking activator is preferably not greater than 20 parts by weight and more preferably not greater than 15 parts by weight.

Preferably, the rubber composition of the inner layer 12 includes an organic sulfur compound. Organic sulfur compounds include naphthalenethiol compounds, benzenethiol compounds, and disulfide compounds. Disulfide compounds are preferable.

Examples of naphthalenethiol compounds include 1-naphthalenethiol, 2-naphthalenethiol, 4-chloro-1-naphthalenethiol, 4-bromo-1-naphthalenethiol, 1-chloro-2-naphthalenethiol, 1-bromo-2-naphthalenethiol, 1-fluoro-2-naphthalenethiol, 1-cyano-2-naphthalenethiol, and 1-acetyl-2-naphthalenethiol.

Examples of benzenethiol compounds include benzenethiol, 4-chlorobenzenethiol, 3-chlorobenzenethiol, 4-bromobenzenethiol, 3-bromobenzenethiol, 4-fluorobenzenethiol, 4-iodobenzenethiol, 2,5-dichlorobenzenethiol, 3,5-dichlorobenzenethiol, 2,6-dichlorobenzenethiol, 2,5-dibromobenzenethiol, 3,5-dibromobenzenethiol, 2-chloro-5-bromobenzenethiol, 2,4,6-trichlorobenzenethiol, 2,3,4,5,6-pentachlorobenzenethiol, 2,3,4,5,6-pentafluorobenzenethiol, 4-cyanobenzenethiol, 2-cyanobenzenethiol, 4-nitrobenzenethiol, and 2-nitrobenzenethiol.

Examples of disulfide compounds include diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide, bis(4-cyanophenyl)disulfide, bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, bis(2-cyano-5-bromophenyl)disulfide, bis(2,4,6-trichlorophenyl)disulfide, bis(2-cyano-4-chloro-6-bromophenyl)disulfide, bis(2,3,5,6-tetrachlorophenyl)disulfide, bis(2,3,4,5,6-pentachlorophenyl)disulfide, and bis(2,3,4,5,6-pentabromophenyl)disulfide.

In light of resilience performance, the amount of the organic sulfur compound per 100 parts by weight of the base rubber is preferably not less than 0.1 parts by weight and particularly preferably not less than 0.2 parts by weight. In light of stability of spin rate and flight distance and feel at impact, the amount of the organic sulfur compound is preferably not greater than 1.5 parts by weight, more preferably not greater than 1.0 part by weight, and particularly preferably not greater than 0.8 parts by weight. Two or more organic sulfur compounds may be used in combination.

The rubber composition of the inner layer 12 may include a filler for the purpose of specific gravity adjustment and the like. Examples of suitable fillers include zinc oxide, barium sulfate, calcium carbonate, and magnesium carbonate. The amount of the filler is determined as appropriate so that the intended specific gravity of the inner layer 12 is accomplished.

Unless the advantageous effects of the present invention are impaired, the rubber composition of the inner layer 12 may include various additives, such as sulfur, a carboxylic acid, a carboxylate, an anti-aging agent, a coloring agent, a plasticizer, a dispersant, and the like, in an adequate amount. The rubber composition may include crosslinked rubber powder or synthetic resin powder.

The inner layer 12 preferably has a weight of not less than 1.5 g and not greater than 24.0 g. The temperature for crosslinking the inner layer 12 is not lower than 140° C. and not higher than 180° C. The time for crosslinking the inner layer 12 is not shorter than 5 minutes and not longer than 60 minutes.

The inner layer 12 has a diameter Di of not less than 10 mm and not greater than 34 mm. The inner layer 12 having a diameter Di of not less than 10 mm significantly achieves the effect of the butyl-based rubber included in the rubber composition of the inner layer 12. From this viewpoint, the diameter Di of the inner layer 12 is preferably not less than 15 mm and more preferably not less than 20 mm. When the inner layer 12 has a diameter Di of not greater than 34 mm, the outer layer 14 having a sufficiently large thickness is formed, and the core 4 having excellent resilience performance is obtained. From this viewpoint, the diameter Di of the inner layer 12 is preferably not greater than 32 mm.

In light of resilience performance, the inner layer 12 has a specific gravity di of preferably not less than 1.05 and more preferably not less than 1.07. In light of feel at impact and flight distance, the specific gravity di of the inner layer 12 is preferably not greater than 1.25 and more preferably not greater than 1.20. In the present specification, the specific gravity means the ratio of the density of an object to the density of water at 4° C.

In light of stability of spin rate and flight distance and feel at impact, a Shore C hardness H0 at the central point of the inner layer 12 (that is, a hardness at the central point of the core 4) is preferably not less than 40 and more preferably not less than 45. In light of flight performance, the hardness H0 is preferably not greater than 65 and more preferably not greater than 60.

In light of flight performance, a Shore C hardness H1 at the surface of the inner layer 12 is preferably not less than 65 and more preferably not less than 67. In light of feel at impact, the hardness H1 is preferably not greater than 80 and more preferably not greater than 75.

A Shore C type hardness scale mounted to an automated hardness meter (trade name "digi test II" manufactured by Heinrich Bareiss Prüfgerätebau GmbH) is used for measuring hardnesses. The hardness H0 is measured by pressing this hardness meter against a cut plane of the inner layer 12 that has been cut into two halves. The hardness H1 is measured by pressing this hardness meter against the surface of the inner layer 12. All the measurements are conducted in an environment of 23° C.

In light of flight performance, the difference (H1−H0) is preferably not less than 5 and more preferably not less than 8. In light of feel at impact, the difference (H1−H0) is preferably not greater than 20 and more preferably not greater than 15.

In light of shock absorbing performance, the inner layer 12 has an amount of compressive deformation Si of preferably not less than 3.0 mm and particularly preferably not less than 3.5 mm. In light of resilience performance of the inner layer 12, the amount of compressive deformation Si of the inner layer 12 is preferably not greater than 6.5 mm and particularly preferably not greater than 6.0 mm.

For measurement of the amount of compressive deformation Si, a YAMADA type compression tester is used. In the tester, a sphere (inner layer 12) to be measured is placed on a hard plate made of metal. Next, a cylinder made of metal gradually descends toward the sphere. The sphere, squeezed between the bottom face of the cylinder and the hard plate, becomes deformed. A migration distance (mm) of the cylinder, starting from the state in which an initial load of 98 N is applied to the sphere up to the state in which a final load of 981 N is applied thereto, is measured.

Preferably, the outer layer 14 is obtained by crosslinking a rubber composition. Examples of preferable base rubbers for use in the rubber composition include natural rubber (NR), isoprene rubber (IR), butadiene rubber (BR), styrene-butadiene rubber (SBR), styrene-isoprene-butadiene rubber (SIBR), ethylene-propylene-diene rubber (EPDM), nitrile rubber (NBR), chloroprene rubber (CR), styrene-isoprene rubber, and butadiene-isoprene rubber. Two or more types of rubbers may be used in combination. In light of resilience performance and feel at impact, the rubber composition of the outer layer 14 preferably does not include the aforementioned butyl-based rubber as a base rubber.

In light of resilience performance, preferable base rubbers are butadiene rubbers. When a butadiene rubber and another rubber are used in combination, it is preferred if the butadiene rubber is included as a principal component. Specifically, the proportion of the butadiene rubber to the entire base rubber is preferably not less than 50% by weight and particularly preferably not less than 80% by weight. The proportion of cis-1,4 bonds in the butadiene rubber is preferably not less than 40% and more preferably not less than 80%.

Preferably, the rubber composition of the outer layer 14 includes the co-crosslinking agent described above for the inner layer 12. In light of resilience performance, preferable co-crosslinking agents are zinc acrylate and zinc methacrylate. In light of resilience performance, the amount of the co-crosslinking agent per 100 parts by weight of the base rubber is preferably not less than 25 parts by weight, more preferably not less than 27 parts by weight, and particularly preferably not less than 30 parts by weight. In light of feel at impact, the amount of the co-crosslinking agent per 100 parts by weight of the base rubber is preferably not greater than 50 parts by weight, more preferably not greater than 45 parts by weight, and particularly preferably not greater than 40 parts by weight. In light of flight performance, the amount of the co-crosslinking agent in the rubber composition of the outer layer 14 is preferably greater than the amount of the co-crosslinking agent in the rubber composition of the inner layer 12.

Preferably, the rubber composition of the outer layer 14 includes the organic peroxide described above for the inner layer 12. A preferable organic peroxide is dicumyl peroxide. In light of resilience performance, the amount of the organic peroxide per 100 parts by weight of the base rubber is preferably not less than 0.1 parts by weight, more preferably not less than 0.3 parts by weight, and particularly preferably not less than 0.5 parts by weight. In light of feel at impact, the amount of the organic peroxide per 100 parts by weight of the base rubber is preferably not greater than 2.0 parts by weight, more preferably not greater than 1.5 parts by weight, and particularly preferably not greater than 1.0 part by weight.

Preferably, the rubber composition of the outer layer 14 includes the organic sulfur compound described above for the inner layer 12. In light of resilience performance, the amount of the organic sulfur compound per 100 parts by weight of the base rubber is preferably not less than 0.1 parts by weight and more preferably not less than 0.2 parts by weight. In light of feel at impact, the amount of the organic sulfur compound per 100 parts by weight of the base rubber is preferably not greater than 1.5 parts by weight, more preferably not greater than 1.0 part by weight, and particularly preferably not greater than 0.8 parts by weight.

The rubber composition of the outer layer 14 may include a carboxylic acid and/or a metal salt thereof in addition to the aforementioned co-crosslinking agent. A carboxylic acid including a carboxylic acid component having 1 to 30 carbon atoms and/or a metal salt thereof is preferable. Examples of preferable carboxylic acids include: saturated fatty acids such as octanoic acid, lauric acid, myristic acid, stearic acid, and the like; unsaturated fatty acids such as 10-undecylenic acid, myristoleic acid, palmitoleic acid, oleic acid, linolic acid, and the like; and aromatic carboxylic acids such as benzoic acid, phthalic acid, salicylic acid, and the like. Examples of the metal component forming the carboxylic acid metal salt include magnesium, calcium, zinc, barium, and the like.

When the rubber composition of the outer layer 14 includes a carboxylic acid and/or a metal salt thereof in addition to the co-crosslinking agent, the amount of the carboxylic acid and/or the metal salt thereof per 100 parts by weight of the base rubber is preferably not less than 0.5 parts by weight and more preferably not less than 1.0 part by weight in light of flight performance. In light of durability, the amount of the carboxylic acid and/or the metal salt thereof per 100 parts by weight of the base rubber is preferably not greater than 20 parts by weight and more preferably not greater than 10 parts by weight. Two or more carboxylic acids and/or metal salts thereof may be used in combination.

Preferably, the rubber composition of the outer layer 14 includes the filler described above for the inner layer 12. A preferable filler is zinc oxide. The amount of the filler is determined as appropriate so that the intended specific gravity of the outer layer 14 is accomplished. The rubber composition of the outer layer 14 includes various additives such as sulfur, an anti-aging agent, a coloring agent, a plasticizer, a dispersant, and the like, in an adequate amount as necessary. The rubber composition of the outer layer 14 may include crosslinked rubber powder or synthetic resin powder.

In formation of the outer layer 14, the inner layer 12 is covered with two uncrosslinked or semi-crosslinked half shells. These half shells are compressed and heated. By this heating, a crosslinking reaction takes place to complete the outer layer 14. The crosslinking temperature is preferably not lower than 140° C. and not higher than 180° C. The time for crosslinking the outer layer 14 is preferably not shorter than 10 minutes and not longer than 60 minutes.

In light of feel at impact, the outer layer 14 has a thickness To of preferably not less than 3 mm, more preferably not less than 4 mm, and further preferably not less than 5 mm. In light of shock absorbing performance, the thickness To of the outer layer 14 is preferably not greater than 15 mm, more preferably not greater than 13 mm, and particularly preferably not greater than 10 mm.

In light of resilience performance, the outer layer 14 has a specific gravity do of preferably not less than 1.05 and more preferably not less than 1.07. In light of feel at impact, the specific gravity do of the outer layer 14 is preferably not greater than 1.20 and more preferably not greater than 1.15. In light of flight performance and durability, the specific gravity do of the outer layer 14 is preferably equal to or greater than the specific gravity di of the inner layer 12. The specific gravity do is more preferably equal to the specific gravity di.

Preferably, in the outer layer 14, the hardness gradually increases from its innermost portion toward its surface. In light of flight performance, a Shore C hardness H2 at the surface of the outer layer 14 (that is, a surface hardness of the core 4) is preferably not less than 75 and more preferably not less than 80. In light of feel at impact and durability, the hardness H2 is preferably not greater than 95 and more preferably not greater than 93. The hardness H2 is measured by pressing a Shore C type hardness scale, mounted to an automated hardness meter (trade name "digi test II" manufactured by Heinrich Bareiss Prüfgerätebau GmbH), against the surface of the core 4.

In the golf ball 2 according to the present invention, the difference (H2−H0) between the Shore C hardness H2 at the surface of the outer layer 14 and the Shore C hardness H0 at the central point of the inner layer 12, that is, the difference between the surface hardness and the central hardness of the core 4, is less than 35. The golf ball 2 that includes the core 4 having a hardness difference (H2−H0) of less than 35 has excellent durability to breakage when being repeatedly hit with a golf club. The golf ball 2 can be continuously used over a long period of time. From this viewpoint, the hardness difference (H2−H0) is preferably not greater than 32 and more preferably not greater than 30. In light of flight performance, the hardness difference (H2−H0) is preferably not less than 15 and more preferably not less than 18.

In light of shock absorbing performance and feel at impact, the Shore C hardness H2 at the surface of the outer layer 14 is preferably greater than the Shore C hardness H1 at the surface of the inner layer 12. The feel at impact of the golf ball 2 in which the hardness H2 is greater than the hardness H1 is soft. From this viewpoint, the hardness difference (H2−H1) is preferably not less than 6 and more preferably not less than 8. In light of durability, the hardness difference (H2−H1) is preferably not greater than 20.

In light of resilience performance, the core 4 has a diameter of preferably not less than 37.0 mm, more preferably not less than 38.0 mm, and particularly preferably not less than 38.5 mm. In light of durability of the golf ball 2, the diameter of the core 4 is preferably not greater than 40.2 mm and more preferably not greater than 39.9 mm. The core 4 preferably has a weight of not less than 10 g and not greater than 42 g. The core 4 may further have another layer in addition to the inner layer 12 and the outer layer 14.

In light of shock absorbing performance and feel at impact, the core 4 has an amount of compressive deformation Sc of preferably not less than 2.3 mm, more preferably not less than 2.4 mm, and particularly preferably not less than 2.5 mm. In light of resilience performance, the amount of compressive deformation Sc is preferably not greater than 4.0 mm, more preferably not greater than 3.9 mm, and particularly preferably not greater than 3.8 mm. The method for measuring the amount of compressive deformation Sc of the core 4 will be described later.

In the golf ball 2, the mid layer 6 is formed outside the core 4. The mid layer 6 may include two or more layers. Another layer may be further provided between the mid layer 6 and the core 4. In the present invention, an embodiment in which the golf ball 2 does not include the mid layer 6 is also possible.

The mid layer 6 is formed from a resin composition. Examples of the base polymer of the resin composition include ionomer resins, polystyrenes, polyesters, polyamides, and polyolefins.

Particularly preferable base resins are ionomer resins. The golf ball 2 having the mid layer 6 that includes an ionomer resin has excellent resilience performance. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion. Two or more ionomer resins may be used in combination.

Specific examples of ionomer resins include trade names "Himilan 1555", "Himilan 1557", "Himilan 1605", "Himilan 1706", "Himilan 1707", "Himilan 1856", "Himilan 1855", "Himilan AM7337", "Himilan AM7311", "Himilan AM7315", "Himilan AM7317", "Himilan AM7318", "Himilan AM7329", "Himilan MK7320", and "Himilan MK7329", manufactured by Du Pont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", manufactured by E.I. du Pont de Nemours and Company; and trade names "IOTEK 7010", "IOTEK 7030", "IOTEK 7510", "IOTEK 7520", "IOTEK 8000", and "IOTEK 8030", manufactured by ExxonMobil Chemical Corporation.

For the mid layer 6, an ionomer resin and another resin may be used in combination. In this case, the principal component of the base resin is preferably the ionomer resin. Specifically, the proportion of the ionomer resin to the entire base resin is preferably not less than 70% by weight, more preferably not less than 80% by weight, and particularly preferably not less than 90% by weight.

A preferable resin that is used in combination with an ionomer resin is a styrene block-containing thermoplastic elastomer. The styrene block-containing thermoplastic elastomer has excellent compatibility with ionomer resins. A resin composition including the styrene block-containing thermoplastic elastomer has excellent fluidity.

The styrene block-containing thermoplastic elastomer includes a polystyrene block as a hard segment, and a soft segment. A typical soft segment is a diene block. Examples of compounds for the diene block include butadiene, isoprene, 1,3-pentadiene, and 2,3-dimethyl-1,3-butadiene. Butadiene and isoprene are preferred. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of flight performance, the content of the styrene component in the styrene block-containing thermoplastic elastomer is preferably not less than 10% by weight, more preferably not less than 12% by weight, and particularly preferably not less than 15% by weight. In light of resilience performance, this content is preferably not greater than 50% by weight, more preferably not greater than 47% by weight, and particularly preferably not greater than 45% by weight.

Styrene block-containing thermoplastic elastomers include a polymer alloy of an olefin and one or more members selected from the group consisting of SBS, SIS, SIBS, and a hydrogenated product thereof. The olefin component in the polymer alloy is presumed to contribute to improvement of compatibility with ionomer resins. Use of this polymer alloy in the resin composition of the mid layer 6 improves the resilience performance of the golf ball 2. An olefin having 2 to 10 carbon atoms is preferably used. Examples of suitable olefins include ethylene, propylene, butene, and pentene. Ethylene and propylene are particularly preferred.

Specific examples of polymer alloys include trade names "RABALON T3221C", "RABALON T3339C", "RABALON SJ4400N", "RABALON SJ5400N", "RABALON SJ6400N", "RABALON SJ7400N", "RABALON SJ8400N", "RABALON SJ9400N", and "RABALON SR04", manufactured by Mitsubishi Chemical Corporation. Other specific examples of styrene block-containing thermoplastic elastomers include trade name "Epofriend A1010" manufactured by Daicel Chemical Industries, Ltd., and trade name "SEPTON HG-252" manufactured by Kuraray Co., Ltd.

The resin composition of the mid layer 6 may include a coloring agent such as titanium dioxide, a filler such as barium sulfate, a dispersant, an antioxidant, an ultraviolet absorber, a light stabilizer, a fluorescent material, a fluorescent brightener, and the like. For the purpose of adjusting specific gravity, the resin composition may include powder of a metal with a high specific gravity such as tungsten, molybdenum, and the like.

For forming the mid layer 6, known methods such as injection molding, compression molding, and the like can be used. In light of flight performance, the mid layer 6 has a thickness Tm of preferably not less than 0.2 mm and more preferably not less than 0.3 mm. In light of stability of spin rate and flight distance, the thickness Tm is preferably not greater than 2.5 mm and more preferably not greater than 2.2 mm. The thickness Tm of the mid layer 6 is measured at a position immediately below the land 18.

In light of flight performance, the mid layer 6 has a Shore D hardness Hm-d of preferably not less than 50 and more preferably not less than 55. In light of feel at impact, the hardness Hm-d is preferably not greater than 80 and particularly preferably not greater than 75. From the same viewpoint, the mid layer 6 has a Shore C hardness Hm-c of preferably not less than 80 and more preferably not less than 85. The hardness Hm-c is preferably not greater than 100 and more preferably not greater than 95.

The hardness of the mid layer 6 is measured according to the standards of "ASTM-D 2240-68". The hardness Hm-d is measured with a Shore D type hardness scale mounted to an automated hardness meter (trade name "digi test II" manufactured by Heinrich Bareiss Prüfgerätebau GmbH). The hardness Hm-c is measured with a Shore C type hardness scale mounted to the automated hardness meter (trade name "digi test II" manufactured by Heinrich Bareiss Prüfgerätebau GmbH). For the measurement, a sheet that is formed by hot press, is formed from the same material as that of the mid layer 6, and has a thickness of about 2 mm, is used. Prior to the measurement, a sheet is kept at 23° C. for two weeks. At the time of measurement, three sheets are stacked.

The cover 10 is formed from a resin composition. Examples of the base resin of the resin composition include polyurethanes, polyesters, polyamides, polyolefins, polystyrenes, and ionomer resins. Particularly, polyurethanes are preferable. Polyurethanes are flexible. The feel at impact of the golf ball 2 that includes the cover 10 formed from the resin composition including a polyurethane is soft.

A more preferable base resin of the resin composition of the cover 10 is a thermoplastic polyurethane elastomer. The thermoplastic polyurethane elastomer includes a polyurethane component as a hard segment and a polyester component or a polyether component as a soft segment.

The polyurethane component has, within the molecule, a urethane bond formed by a reaction of a polyol and an isocyanate. The polyol has a plurality of hydroxyl groups. Low-molecular-weight polyols and high-molecular-weight polyols can be used.

Examples of the isocyanate for the polyurethane component include alicyclic diisocyanates, aromatic diisocyanates, and aliphatic diisocyanates. Two or more diisocyanates may be used in combination.

Examples of alicyclic diisocyanates include 4,4'-dicyclohexylmethane diisocyanate ($H_{12}$MDI), 1,3-bis(isocyanatomethyl)cyclohexane ($H_6$XDI), isophorone diisocyanate (IPDI), and trans-1,4-cyclohexane diisocyanate (CHDI). In light of versatility and processability, $H_{12}$MDI is preferable.

Examples of aromatic diisocyanates include 4,4'-diphenylmethane diisocyanate (MDI) and toluene diisocyanate (TDI). Examples of aliphatic diisocyanates include hexamethylene diisocyanate (HDI).

Alicyclic diisocyanates are particularly preferable. Since an alicyclic diisocyanate does not have any double bond in the main chain, the alicyclic diisocyanate suppresses yellowing of the cover 10. In addition, since an alicyclic diisocyanate has excellent strength, the alicyclic diisocyanate suppresses damage of the cover 10.

Specific examples of thermoplastic polyurethane elastomers include trade names "Elastollan NY80A", "Elastollan NY82A", "Elastollan NY83A", "Elastollan NY84A", "Elastollan NY85A", "Elastollan NY88A", "Elastollan NY90A", "Elastollan NY97A", "Elastollan NY585", "Elastollan XKP016N", "Elastollan 1195ATR", "Elastollan ET890A", and "Elastollan ET88050", manufactured by BASF Japan Ltd.; and trade names "RESAMINE P4585LS" and "RESAMINE PS62490", manufactured by Dainichiseika Color & Chemicals Mfg. Co., Ltd.

A thermoplastic polyurethane elastomer and another resin may be used in combination. Examples of the resin that can be used in combination include thermoplastic polyester elastomers, thermoplastic polyamide elastomers, thermoplastic polyolefin elastomers, styrene block-containing thermoplastic elastomers, and ionomer resins. When a thermoplastic polyurethane elastomer and another resin are used in combination, the thermoplastic polyurethane elastomer is included as the principal component of the base resin, in light of feel at impact. The proportion of the thermoplastic polyurethane elastomer to the entire base resin is preferably not less than 70% by weight, more preferably not less than 80% by weight, and particularly preferably not less than 90% by weight.

As necessary, a pigment component such as a white pigment (for example, titanium dioxide), a blue pigment, a red pigment, and the like, a weight adjusting agent such as zinc oxide, calcium carbonate, barium sulfate, and the like, a dispersant, an anti-aging agent, an ultraviolet absorber, a light stabilizer, a fluorescent material, a fluorescent brightener, and the like can be included in an adequate amount in the cover 10.

For forming the cover 10, known methods such as injection molding, compression molding, and the like can be used. When forming the cover 10, the dimples 16 are formed by pimples formed on the cavity face of a mold.

In light of feel at impact, the cover 10 has a thickness Tc of preferably not less than 0.1 mm and more preferably not less than 0.2 mm. In light of flight performance, the thickness Tc of the cover 10 is preferably not greater than 0.8 mm and more preferably not greater than 0.7 mm.

In light of flight performance, the cover 10 has a Shore D hardness Hc of preferably not less than 25 and more preferably not less than 30. In light of feel at impact, the hardness Hc of the cover 10 is preferably not greater than 50 and more preferably not greater than 45. The Shore D hardness Hc of the cover 10 is measured in the same manner as for the Shore D hardness Hm-d of the mid layer 6.

The golf ball 2 includes the reinforcing layer 8 between the mid layer 6 and the cover 10. The reinforcing layer 8 firmly adheres to the mid layer 6 and also to the cover 10. When the resin composition that forms the mid layer 6 and the resin composition that forms the cover 10 include different types of base resins, the reinforcing layer 8 suppresses separation of the cover 10 from the mid layer 6. The reinforcing layer 8 is formed from a resin composition. Examples of a preferable base resin of the resin composition include two-component curing type epoxy resins and two-component curing type urethane resins. As long as the object of the present invention is achieved, the golf ball 2 does not have to include the reinforcing layer 8.

In light of feel at impact, the golf ball 2 has an amount of compressive deformation Sb of preferably not less than 2.3 mm and more preferably not less than 2.5 mm. In light of resilience performance, the amount of compressive deformation Sb is preferably not greater than 4.0 mm and more preferably not greater than 3.8 mm.

For measurement of the amount of compressive deformation Sc of the core 4 and the amount of compressive deformation Sb of the golf ball 2, the YAMADA type compression tester described above for the inner layer 12 is used. For the core 4 and the golf ball 2, a migration distance (mm) of the cylinder, starting from the state in which an initial load of 98 N is applied to a sphere (the core 4, the golf ball 2) up to the state in which a final load of 1274 N is applied thereto, is measured as an amount of compressive deformation. A moving speed of the cylinder until the initial load is applied is 0.83 mm/s. A moving speed of the cylinder after the initial load is applied until the final load is applied is 1.67 mm/s.

EXAMPLES

The following will show the effects of the present invention by means of Examples, but the present invention should not be construed in a limited manner on the basis of the description of these Examples.

Example 1

A rubber composition B was obtained by kneading 90 parts by weight of a high-cis polybutadiene (trade name "BR-730", manufactured by JSR Corporation), 10 parts by weight of a butyl rubber (trade name "Butyl 1268", manufactured by JSR Corporation), 22.5 parts by weight of zinc diacrylate (trade name "Sanceler SR", manufactured by SANSHIN CHEMICAL INDUSTRY CO., LTD.), 5 parts by weight of zinc oxide (trade name "Ginrei R", manufactured by Toho Zinc Co., Ltd.), an appropriate amount of barium sulfate (trade name "Barium Sulfate BD", manufactured by Sakai Chemical Industry Co., Ltd.), 0.5 parts by weight of diphenyl disulfide (manufactured by Sumitomo Seika Chemicals Co., Ltd.), and 0.9 parts by weight of dicumyl peroxide (trade name "Percumyl D", manufactured by NOF Corporation). The rubber composition B was placed into a mold including upper and lower mold halves each having a hemispherical cavity, and heated at 170° C. for 15 minutes to obtain an inner layer with a diameter Di of 15 mm. The specific gravity di of the inner layer was 1.13.

A rubber composition a was obtained by kneading 100 parts by weight of a high-cis polybutadiene (the aforementioned "BR-730"), 29.5 parts by weight of zinc diacrylate (the aforementioned "Sanceler SR"), 5 parts by weight of zinc oxide (the aforementioned "Ginrei R"), an appropriate amount of barium sulfate (the aforementioned "Barium Sulfate BD"), 0.1 parts by weight of 2-naphthalenethiol (manufactured by Tokyo Chemical Industry Co., Ltd.), 2 parts by weight of benzoic acid (manufactured by Tokyo Chemical Industry Co., Ltd.), 0.3 parts by weight of bis (pentabromophenyl)disulfide (PBDS) (manufactured by Kawaguchi Chemical Industry Co., Ltd.), and 0.9 parts by weight of dicumyl peroxide (the aforementioned "Percumyl D"). Half shells were formed from the rubber composition a. The inner layer was covered with two of these half shells. The inner layer and the half shells were placed into a mold including upper and lower mold halves each having a hemispherical cavity, and heated at 150° C. for 20 minutes to obtain a core with a diameter of 39.7 mm. An outer layer was formed from the rubber composition a. The thickness To of the outer layer was 12.35 mm. The amount of barium sulfate was adjusted such that the specific gravity do of the outer layer was equal to the specific gravity di of the inner layer and the weight of a golf ball was 45.4 g.

A resin composition M1 was obtained by kneading 47 parts by weight of an ionomer resin (the aforementioned "Himilan 1605"), 50 parts by weight of another ionomer resin (the aforementioned "Himilan AM7329"), 3 parts by weight of a styrene block-containing thermoplastic elastomer (the aforementioned "RABALON T3221C"), and 4 parts by weight of titanium dioxide (manufactured by Ishihara Sangyo Kaisha, Ltd.) with a twin-screw kneading extruder. The core was covered with the resin composition M1 by injection molding to form a mid layer with a thickness Tm of 1.0 mm. The hardness Hm-d of the mid layer was 63, and the hardness Hm-c of the mid layer was 91.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type solid epoxy resin and 70 parts by weight of a solvent. The curing agent liquid of this paint composition includes 40 parts by weight of a modified polyamide amine, 55 parts by weight of a solvent, and 5 parts by weight of titanium dioxide. The weight ratio of the base material liquid to the curing agent liquid is 1/1. This paint composition was applied to the surface of the mid layer with an air gun, and kept at 23° C. for 12 hours to obtain a reinforcing layer with a thickness of 10 μm.

A resin composition C1 was obtained by kneading 100 parts by weight of a thermoplastic polyurethane elastomer (trade name "Elastollan NY84A", manufactured by BASF Japan Ltd.), 0.2 parts by weight of a light stabilizer (trade name "TINUVIN 770", manufactured by BASF Japan Ltd.), and 4 parts by weight of titanium dioxide with a twin-screw kneading extruder. Half shells were obtained from the resin composition C1 by compression molding. The sphere consisting of the core, the mid layer, and the reinforcing layer was covered with two of these half shells. These half shells and the sphere were placed into a final mold that includes upper and lower mold halves each having a hemispherical cavity and having a large number of pimples on its cavity face, and a cover with a thickness Tc of 0.5 mm was formed by compression molding. The Shore D hardness Hc of the cover was 31.

Examples 2 to 19 and Comparative Examples 1 to 11

Golf balls of Examples 2 to 19 and Comparative Examples 1 to 11 were obtained in the same manner as Example 1, except the specifications of the inner layer and the outer layer were as shown in Tables 9 to 15 below. The composition of the inner layer is shown in detail in Tables 1 to 4 below. The composition of the outer layer is shown in detail in Tables 5 and 6 below. The compositions of the mid layer and the cover are shown in detail in Tables 7 and 8 below, respectively. In Examples 15 to 18, the amount of barium sulfate was changed and adjusted such that the inner layer and the outer layer had predetermined specific gravities.

[Flight Test (1)]

A 5-iron (trade name "XXIO", manufactured by DUNLOP SPORTS CO. LTD., shaft hardness: R) was attached to a swing machine manufactured by Golf Laboratories, Inc. A golf ball was hit under the following conditions, and the spin rate (rpm) immediately after the hit and the flight distance (m) from the hitting spot to the stop spot were measured. The averages of values obtained from 10 measurements are shown as a spin rate S1 and a flight distance D1 in Tables 9 to 15 below.

Head speed: 34 m/s

Effective loft angle: 23.5°

Hitting point: a point lower than the face center by 5 mm

[Flight Test (2)]

The spin rate (rpm) immediately after a hit and the flight distance (m) from the hitting spot to the stop spot were measured in the same manner as Flight Test (1), except the effective loft angle and the hitting point were changed to the following conditions. The averages of values obtained from 10 measurements are shown as a spin rate S2 and a flight distance D2 in Tables 9 to 15 below.

Head speed: 34 m/s

Effective loft angle: 20.5°

Hitting point: a point higher than the face center by 5 mm

[Feel at Impact]

Ten golf players hit golf balls with drivers and were asked about feel at impact. The evaluation was categorized as follows on the basis of the number of golf players who answered, "the feel at impact was good". The results are shown in Tables 9 to 15 below.

A: 8 to 10

B: 6 to 7

C: 4 to 5

D: 0 to 3

[Durability]

A driver (trade name "XXIO8", manufactured by DUNLOP SPORTS CO. LTD., shaft hardness: R, loft angle 10.5°) was attached to a swing machine manufactured by Golf Laboratories, Inc. A golf ball was repeatedly hit under the condition of a head speed of 45 m/sec. The number of hits required to break the golf ball was counted. When the cover was not broken and the core or the mid layer was broken, the breakage was recognized through deformation of the golf ball or unusual sound at hit of the golf ball. The average value of data obtained by 12 measurements was obtained, and the durability of each golf ball was evaluated with the result of Example 1 as a reference.

TABLE 1

Composition of Inner Layer (parts by weight)

| | A | B | C | D |
|---|---|---|---|---|
| Polybutadiene | 100 | 90 | 80 | 70 |
| Butyl 1268 | 0 | 10 | 20 | 30 |
| Butyl 1065 | 0 | 0 | 0 | 0 |

TABLE 1-continued

| Composition of Inner Layer (parts by weight) | A | B | C | D |
|---|---|---|---|---|
| CHLOROBUTYL 1066 | 0 | 0 | 0 | 0 |
| BROMOBUTYL 2255 | 0 | 0 | 0 | 0 |
| IR2200 | 0 | 0 | 0 | 0 |
| Zinc diacrylate | 25.0 | 22.5 | 20.0 | 18.0 |
| Zinc oxide | 5 | 5 | 5 | 5 |
| Barium sulfate | * | * | * | * |
| Diphenyl disulfide | 0.5 | 0.5 | 0.5 | 0.5 |
| Dicumyl peroxide | 0.7 | 0.9 | 0.9 | 0.9 |

*) Appropriate amount

TABLE 2

| Composition of Inner Layer (parts by weight) | E | F | G | H | I |
|---|---|---|---|---|---|
| Polybutadiene | 90 | 90 | 90 | 90 | 70 |
| Butyl 1268 | 0 | 0 | 0 | 0 | 0 |
| Butyl 1065 | 10 | 0 | 0 | 0 | 0 |
| CHLOROBUTYL 1066 | 0 | 10 | 0 | 0 | 0 |
| BROMOBUTYL 2255 | 0 | 0 | 10 | 0 | 0 |
| IR2200 | 0 | 0 | 0 | 10 | 30 |
| Zinc diacrylate | 23.5 | 23.0 | 23.0 | 26.0 | 27.5 |
| Zinc oxide | 5 | 5 | 5 | 5 | 5 |
| Barium sulfate | * | * | * | * | * |
| Diphenyl disulfide | 0.5 | 0.5 | 0.5 | 0.5 | 0.5 |
| Dicumyl peroxide | 0.7 | 0.9 | 0.9 | 0.9 | 0.9 |

*) Appropriate amount

TABLE 3

| Composition of Inner Layer (parts by weight) | J | K | L | M | N |
|---|---|---|---|---|---|
| Polybutadiene | 90 | 90 | 95 | 60 | 55 |
| Butyl 1268 | 10 | 0 | 5 | 40 | 45 |
| Butyl 1065 | 0 | 0 | 0 | 0 | 0 |
| CHLOROBUTYL 1066 | 0 | 0 | 0 | 0 | 0 |
| BROMOBUTYL 2255 | 0 | 0 | 0 | 0 | 0 |
| IR2200 | 0 | 0 | 0 | 0 | 0 |
| Polyisobutylene | 0 | 10 | 0 | 0 | 0 |
| Zinc diacrylate | 16.0 | 23.0 | 23.5 | 17.0 | 16.0 |
| Zinc oxide | 5 | 5 | 5 | 5 | 5 |
| Barium sulfate | * | * | * | * | * |
| Diphenyl disulfide | 0.5 | 0.5 | 0.5 | 0.5 | 0.5 |
| Dicumyl peroxide | 0.9 | 0.7 | 0.9 | 0.9 | 0.9 |

*) Appropriate amount

TABLE 4

| Composition of Inner Layer (parts by weight) | O | P | Q | R | S |
|---|---|---|---|---|---|
| Polybutadiene | 90 | 90 | 90 | 90 | 90 |
| Butyl 1268 | 10 | 10 | 10 | 10 | 10 |
| Butyl 1065 | 0 | 0 | 0 | 0 | 0 |
| CHLOROBUTYL 1066 | 0 | 0 | 0 | 0 | 0 |
| BROMOBUTYL 2255 | 0 | 0 | 0 | 0 | 0 |
| IR2200 | 0 | 0 | 0 | 0 | 0 |
| Polyisobutylene | 0 | 0 | 0 | 0 | 0 |
| Zinc diacrylate | 22.5 | 22.5 | 22.5 | 22.5 | 29.5 |
| Zinc oxide | 5 | 5 | 5 | 5 | 5 |
| Barium sulfate | * | * | * | * | * |

TABLE 4-continued

| Composition of Inner Layer (parts by weight) | O | P | Q | R | S |
|---|---|---|---|---|---|
| Diphenyl disulfide | 0.5 | 0.5 | 0.5 | 0.5 | 0.5 |
| Dicumyl peroxide | 0.9 | 0.9 | 0.9 | 0.9 | 0.9 |

*) Appropriate amount

TABLE 5

| Composition of Outer Layer (parts by weight) | a | b | c | d |
|---|---|---|---|---|
| Polybutadiene | 100 | 100 | 100 | 0 |
| Zinc diacrylate | 29.5 | 31.0 | 32.5 | 0 |
| Zinc oxide | 5 | 5 | 5 | 0 |
| Barium sulfate | * | * | * | * |
| 2-naphthalenethiol | 0.1 | 0.1 | 0.1 | 0 |
| Benzoic acid | 2 | 2 | 2 | 0 |
| PBDS | 0.3 | 0.3 | 0.3 | 0 |
| Dicumyl peroxide | 0.9 | 0.9 | 0.9 | 0 |
| Himilan 1605 | 0 | 0 | 0 | 38 |
| Himilan AM7329 | 0 | 0 | 0 | 38 |
| Rabalon T3221C | 0 | 0 | 0 | 24 |

*) Appropriate amount

TABLE 6

| Composition of Outer Layer (parts by weight) | e | f | g | h | i |
|---|---|---|---|---|---|
| Polybutadiene | 100 | 100 | 100 | 100 | 100 |
| Zinc diacrylate | 29.5 | 29.5 | 22.5 | 29.5 | 29.5 |
| Zinc oxide | 5 | 5 | 5 | 5 | 5 |
| Barium sulfate | * | * | * | * | * |
| 2-naphthalenethiol | 0.1 | 0.1 | 0.1 | 0.1 | 0.1 |
| Benzoic acid | 2 | 2 | 2 | 2 | 2 |
| PBDS | 0.3 | 0.3 | 0.3 | 0.3 | 0.3 |
| Dicumyl peroxide | 0.9 | 0.9 | 0.9 | 0.9 | 0.9 |

*) Appropriate amount

TABLE 7

| Composition of Mid Layer (parts by weight) | M1 |
|---|---|
| Himilan 1605 | 47 |
| Himilan AM7329 | 50 |
| Rabalon T3221C | 3 |
| Titanium dioxide | 4 |
| Hm-d (Shore D) | 63 |
| Hm-c (Shore C) | 91 |

TABLE 8

| Composition of Cover (parts by weight) | C1 |
|---|---|
| Elastollan NY84A | 100 |
| TINUVIN 770 | 0.2 |
| Titanium dioxide | 4 |
| Hc (Shore D) | 31 |

The details of the compounds listed in Tables 1 to 8 are as follows.

Polybutadiene: a high-cis polybutadiene, trade name "BR-730", manufactured by JSR Corporation (cis-1,4-bond content: 96% by weight, 1,2-vinyl bond content: 1.3% by weight, Mooney viscosity (ML1+4(100° C.)): 55, molecular weight distribution (Mw/Mn): 3)

Butyl 1268: a butyl rubber manufactured by JSR Corporation (Mooney viscosity (ML1+8, 125° C.): 51)

Butyl 1065: a butyl rubber manufactured by JSR Corporation (Mooney viscosity (ML1+8, 125° C.): 32)

CHLOROBUTYL 1066: a chlorinated butyl rubber manufactured by JSR Corporation (Mooney viscosity (ML1+8, 125° C.): 38, halogen content: 1.26% by weight)

BROMOBUTYL 2255: a brominated butyl rubber manufactured by JSR Corporation (Mooney viscosity (ML1+8, 125° C.): 46, halogen content: 2.1% by weight)

IR2200: a polyisoprene rubber manufactured by Zeon Corporation (Mooney viscosity (ML1+8, 125° C.): 82)

Polyisobutylene: trade name "Tetrax 4T", manufactured by JXTG Nippon Oil & Energy Corporation (viscosity-average molecular weight: 40000)

Zinc diacrylate: trade name "Sanceler SR", zinc diacrylate, manufactured by SANSHIN CHEMICAL INDUSTRY CO., LTD. (a product coated with 10% by weight of stearic acid)

Zinc oxide: trade name "Ginrei R", manufactured by Toho Zinc Co., Ltd.

Barium sulfate: trade name "Barium Sulfate BD", manufactured by Sakai Chemical Industry Co., Ltd.

Diphenyl disulfide: manufactured by Sumitomo Seika Chemicals Co., Ltd.

Dicumyl peroxide: trade name "Percumyl D", manufactured by NOF Corporation 2-naphthalenethiol: manufactured by Tokyo Chemical Industry Co., Ltd.

PBDS: bis(pentabromophenyl)disulfide manufactured by Kawaguchi Chemical Industry Co., Ltd.

Benzoic acid: manufactured by Tokyo Chemical Industry Co., Ltd.

Himilan 1605: an ionomer resin manufactured by Du Pont-MITSUI POLYCHEMICALS Co., Ltd.

Himilan AM7329: an ionomer resin manufactured by Du Pont-MITSUI POLYCHEMICALS Co., Ltd.

Rabalon T3221C: a styrene block-containing thermoplastic elastomer manufactured by Mitsubishi Chemical Corporation Titanium dioxide: manufactured by Ishihara Sangyo Kaisha, Ltd.

TINUVIN 770: a hindered amine light stabilizer manufactured by Ciba Japan K.K.

TABLE 9

| Results of Evaluation | Ex. 1 | Ex. 2 | Ex. 3 | Ex. 4 | Ex. 5 |
|---|---|---|---|---|---|
| Inner layer | | | | | |
| Composition | B | B | B | B | C |
| Di (mm) | 15 | 25 | 30 | 25 | 25 |
| H0 (Shore C) | 61 | 58 | 56 | 58 | 60 |
| H1 (Shore C) | 69 | 71 | 71 | 71 | 69 |
| di | 1.13 | 1.13 | 1.13 | 1.15 | 1.13 |
| Outer layer | | | | | |
| Composition | a | b | c | a | a |
| To (mm) | 12.35 | 7.35 | 4.85 | 6.75 | 7.35 |

TABLE 9-continued

| Results of Evaluation | Ex. 1 | Ex. 2 | Ex. 3 | Ex. 4 | Ex. 5 |
|---|---|---|---|---|---|
| H2 (Shore C) | 81 | 83 | 86 | 81 | 81 |
| do | 1.13 | 1.13 | 1.13 | 1.15 | 1.13 |
| (H2 − H0) | 20 | 25 | 30 | 23 | 21 |
| Mid layer | | | | | |
| Composition | M1 | M1 | M1 | M1 | M1 |
| Tm (mm) | 1.0 | 1.0 | 1.0 | 1.6 | 1.0 |
| Cover | | | | | |
| Composition | C1 | C1 | C1 | C1 | C1 |
| Tc (mm) | 0.5 | 0.5 | 0.5 | 0.5 | 0.5 |
| Sb (mm) | 2.5 | 2.5 | 2.6 | 2.4 | 2.5 |
| (I#5) Test (1) | | | | | |
| Spin S1 (rpm) | 4705 | 4750 | 4800 | 4660 | 4765 |
| Distance D1 (m) | 139.9 | 139.8 | 139.8 | 140.3 | 139.8 |
| (I#5) Test (2) | | | | | |
| Spin S2 (rpm) | 3795 | 3890 | 4000 | 3780 | 3935 |
| Distance D2 (m) | 148.5 | 148.0 | 147.4 | 148.5 | 147.8 |
| (S1 − S2) (rpm) | 910 | 860 | 800 | 880 | 830 |
| (D2 − D1) (m) | 8.6 | 8.2 | 7.6 | 8.2 | 8.0 |
| Feel at impact | B | B | A | B | A |

TABLE 10

| Results of Evaluation | Ex. 6 | Ex. 7 | Ex. 8 | Ex. 9 |
|---|---|---|---|---|
| Inner layer | | | | |
| Composition | D | E | F | G |
| Di (mm) | 25 | 25 | 25 | 25 |
| H0 (Shore C) | 58 | 58 | 58 | 56 |
| H1 (Shore C) | 70 | 70 | 70 | 71 |
| di | 1.13 | 1.13 | 1.13 | 1.13 |
| Outer layer | | | | |
| Composition | a | a | a | a |
| To (mm) | 7.35 | 7.35 | 7.35 | 7.35 |
| H2 (Shore C) | 81 | 81 | 81 | 81 |
| do | 1.13 | 1.13 | 1.13 | 1.13 |
| (H2 − H0) | 23 | 23 | 23 | 25 |
| Mid layer | | | | |
| Composition | M1 | M1 | M1 | M1 |
| Tm (mm) | 1.0 | 1.0 | 1.0 | 1.0 |
| Cover | | | | |
| Composition | C1 | C1 | C1 | C1 |
| Tc (mm) | 0.5 | 0.5 | 0.5 | 0.5 |
| Sb (mm) | 2.5 | 2.5 | 2.5 | 2.5 |
| (I#5) Test (1) | | | | |
| Spin S1 (rpm) | 4760 | 4780 | 4815 | 4800 |
| Distance D1 (m) | 139.9 | 139.7 | 139.6 | 139.8 |
| (I#5) Test (2) | | | | |
| Spin S2 (rpm) | 4000 | 3940 | 4025 | 4060 |
| Distance D2 (m) | 147.3 | 147.7 | 147.2 | 147.0 |
| (S1 − S2) (rpm) | 760 | 840 | 790 | 740 |
| (D2 − D1) (m) | 7.4 | 8.0 | 7.6 | 7.2 |
| Feel at impact | A | A | B | B |

TABLE 11

| Results of Evaluation | Com. Ex. 1 | Com. Ex. 2 | Com. Ex. 3 | Com. Ex. 4 |
|---|---|---|---|---|
| Inner layer | | | | |
| Composition | A | A | A | H |
| Di (mm) | 15 | 25 | 30 | 15 |
| H0 (Shore C) | 60 | 58 | 57 | 60 |
| H1 (Shore C) | 68 | 70 | 71 | 67 |
| di | 1.13 | 1.13 | 1.13 | 1.13 |
| Outer layer | | | | |
| Composition | a | b | c | a |
| To (mm) | 12.35 | 7.35 | 4.85 | 12.35 |
| H2 (Shore C) | 81 | 83 | 86 | 81 |
| do | 1.13 | 1.13 | 1.13 | 1.13 |
| (H2 − H0) | 21 | 25 | 29 | 21 |
| Mid layer | | | | |
| Composition | M1 | M1 | M1 | M1 |
| Tm (mm) | 1.0 | 1.0 | 1.0 | 1.0 |
| Cover | | | | |
| Composition | C1 | C1 | C1 | C1 |
| Tc (mm) | 0.5 | 0.5 | 0.5 | 0.5 |
| Sb (mm) | 2.5 | 2.5 | 2.6 | 2.5 |
| (I#5) Test (1) | | | | |
| Spin S1 (rpm) | 4790 | 4810 | 4900 | 4800 |
| Distance D1 (m) | 139.0 | 139.2 | 138.9 | 139.1 |
| (I#5) Test (2) | | | | |
| Spin S2 (rpm) | 3570 | 3670 | 3820 | 3640 |
| Distance D2 (m) | 149.8 | 149.4 | 148.7 | 149.5 |
| (S1 − S2) (rpm) | 1220 | 1140 | 1080 | 1160 |
| (D2 − D1) (m) | 10.8 | 10.2 | 9.8 | 10.4 |
| Feel at impact | D | D | C | D |

TABLE 12

| Results of Evaluation | Com. Ex. 5 | Com. Ex. 6 | Com. Ex. 7 | Com. Ex. 8 |
|---|---|---|---|---|
| Inner layer | | | | |
| Composition | H | H | I | H |
| Di (mm) | 25 | 30 | 25 | 25 |
| H0 (Shore C) | 58 | 57 | 57 | 58 |
| H1 (Shore C) | 69 | 70 | 69 | 69 |
| di | 1.13 | 1.13 | 1.13 | 1.15 |
| Outer layer | | | | |
| Composition | b | c | a | a |
| To (mm) | 7.35 | 4.85 | 7.35 | 6.75 |
| H2 (Shore C) | 83 | 86 | 81 | 81 |
| do | 1.13 | 1.13 | 1.13 | 1.15 |
| (H2 − H0) | 25 | 29 | 24 | 24 |
| Mid layer | | | | |
| Composition | M1 | M1 | M1 | M1 |
| Tm (mm) | 1.0 | 1.0 | 1.0 | 1.6 |
| Cover | | | | |
| Composition | C1 | C1 | C1 | C1 |
| Tc (mm) | 0.5 | 0.5 | 0.5 | 0.5 |
| Sb (mm) | 2.5 | 2.5 | 2.5 | 2.4 |
| (I#5) Test (1) | | | | |
| Spin S1 (rpm) | 4825 | 4910 | 4810 | 4775 |
| Distance D1 (m) | 139.2 | 138.8 | 139.4 | 139.2 |

TABLE 12-continued

| Results of Evaluation | Com. Ex. 5 | Com. Ex. 6 | Com. Ex. 7 | Com. Ex. 8 |
|---|---|---|---|---|
| (I#5) Test (2) | | | | |
| Spin S2 (rpm) | 3735 | 3850 | 3830 | 3625 |
| Distance D2 (m) | 149.0 | 148.4 | 148.4 | 149.6 |
| (S1 − S2) (rpm) | 1090 | 1060 | 980 | 1150 |
| (D2 − D1) (m) | 9.8 | 9.6 | 9.0 | 10.4 |
| Feel at impact | C | C | C | D |

TABLE 13

| Results of Evaluation | Com. Ex. 9 | Com. Ex. 10 | Com. Ex. 11 |
|---|---|---|---|
| Inner layer | | | |
| Composition | B | B | J |
| Di (mm) | 9 | 35 | 15 |
| H0 (Shore C) | 64 | 56 | 50 |
| H1 (Shore C) | 68 | 73 | 58 |
| di | 1.13 | 1.13 | 1.13 |
| Outer layer | | | |
| Composition | a | a | c |
| To (mm) | 15.35 | 2.35 | 12.35 |
| H2 (Shore C) | 81 | 80 | 86 |
| do | 1.13 | 1.13 | 1.13 |
| (H2 − H0) | 17 | 24 | 36 |
| Mid layer | | | |
| Composition | M1 | M1 | M1 |
| Tm (mm) | 1.0 | 1.0 | 1.0 |
| Cover | | | |
| Composition | C1 | C1 | C1 |
| Tc (mm) | 0.5 | 0.5 | 0.5 |
| Sb (mm) | 2.3 | 2.8 | 2.6 |
| (I#5) Test (1) | | | |
| Spin S1 (rpm) | 4750 | 5040 | 4645 |
| Distance D1 (m) | 139.5 | 137.6 | 140.1 |
| (I#5) Test (2) | | | |
| Spin S2 (rpm) | 3650 | 4060 | 3655 |
| Distance D2 (m) | 149.5 | 146.6 | 149.3 |
| (S1 − S2) (rpm) | 1100 | 980 | 990 |
| (D2 − D1) (m) | 10.0 | 9.0 | 9.2 |
| Feel at impact | D | C | C |

TABLE 14

| Results of Evaluation | Ex. 10 | Ex. 11 | Ex. 12 | Ex. 13 | Ex. 14 |
|---|---|---|---|---|---|
| Inner layer | | | | | |
| Composition | B | K | L | M | N |
| Di (mm) | 15 | 15 | 15 | 15 | 15 |
| H0 (Shore C) | 61 | 62 | 62 | 63 | 63 |
| H1 (Shore C) | 69 | 69 | 68 | 68 | 68 |
| di | 1.13 | 1.13 | 1.13 | 1.13 | 1.13 |
| Outer layer | | | | | |
| Composition | d | a | a | a | a |
| To (mm) | 12.35 | 12.35 | 12.35 | 12.35 | 12.35 |
| H2 (Shore C) | 74 | 81 | 81 | 81 | 81 |
| do | 1.13 | 1.13 | 1.13 | 1.13 | 1.13 |
| (H2 − H0) | 13 | 19 | 19 | 18 | 18 |

TABLE 14-continued

| Results of Evaluation | | | | | |
|---|---|---|---|---|---|
| | Ex. 10 | Ex. 11 | Ex. 12 | Ex. 13 | Ex. 14 |
| Mid layer | | | | | |
| Composition | M1 | M1 | M1 | M1 | M1 |
| Tm (mm) | 1.0 | 1.0 | 1.0 | 1.0 | 1.6 |
| Cover | | | | | |
| Composition | C1 | C1 | C1 | C1 | C1 |
| Tc (mm) | 0.5 | 0.5 | 0.5 | 0.5 | 0.5 |
| Sb (mm) | 2.5 | 2.5 | 2.5 | 2.5 | 2.5 |
| (I#5) Test (1) | | | | | |
| Spin S1 (rpm) | 4765 | 4690 | 4680 | 4640 | 4670 |
| Distance D1 (m) | 139.7 | 140.1 | 140.1 | 140.6 | 140.5 |
| (I#5) Test (2) | | | | | |
| Spin S2 (rpm) | 3835 | 3810 | 3760 | 3920 | 3990 |
| Distance D2 (m) | 148.3 | 148.3 | 148.7 | 147.6 | 147.3 |
| (S1 − S2) (rpm) | 930 | 880 | 920 | 720 | 680 |
| (D2 − D1) (m) | 8.6 | 8.2 | 8.6 | 7.0 | 6.8 |
| Feel at impact | B | B | B | A | A |

TABLE 15

| Results of Evaluation | | | | | |
|---|---|---|---|---|---|
| | Ex. 15 | Ex. 16 | Ex. 17 | Ex. 18 | Ex. 19 |
| Inner layer | | | | | |
| Composition | O | P | Q | R | S |
| Di (mm) | 15 | 15 | 32 | 32 | 15 |
| H0 (Shore C) | 61 | 61 | 56 | 56 | 66 |
| H1 (Shore C) | 69 | 69 | 71 | 71 | 74 |
| di | 1.03 | 1.22 | 1.13 | 1.13 | 1.13 |
| Outer layer | | | | | |
| Composition | h | i | e | f | g |
| To (mm) | 12.35 | 12.35 | 3.85 | 3.85 | 12.35 |
| H2 (Shore C) | 81 | 81 | 81 | 81 | 71 |
| do | 1.16 | 1.10 | 1.03 | 1.22 | 1.13 |
| (H2 − H0) | 20 | 20 | 25 | 25 | 5 |
| Mid layer | | | | | |
| Composition | M1 | M1 | M1 | M1 | M1 |
| Tm (mm) | 1.0 | 1.0 | 1.0 | 1.6 | 1.0 |
| Cover | | | | | |
| Composition | C1 | C1 | C1 | C1 | C1 |
| Tc (mm) | 0.5 | 0.5 | 0.5 | 0.5 | 0.5 |
| Sb (mm) | 2.5 | 2.5 | 2.5 | 2.5 | 2.6 |
| (I#5) Test (1) | | | | | |
| Spin S1 (rpm) | 4640 | 4865 | 4820 | 4670 | 4970 |
| Distance D1 (m) | 140.4 | 139.2 | 139.4 | 140.3 | 138.2 |
| (I#5) Test (2) | | | | | |
| Spin S2 (rpm) | 3780 | 3935 | 3900 | 3790 | 4130 |
| Distance D2 (m) | 148.6 | 147.8 | 148.0 | 148.5 | 146.2 |
| (S1 − S2) (rpm) | 860 | 930 | 920 | 880 | 840 |
| (D2 − D1) (m) | 8.2 | 8.6 | 8.6 | 8.2 | 8.0 |
| Feel at impact | B | B | B | B | A |

As shown in Tables 9 to 15, in the golf ball of each Example, the spin rate difference (S1−S2) and the flight distance difference (D2−D1) are small as compared to those of the golf ball of each Comparative Example. In other words, the golf ball of each Example has excellent spin rate stability and excellent flight distance stability as compared to the golf ball of each Comparative Example. Furthermore, in the golf ball of each Example, the feel at impact is highly rated as compared to that of the golf ball of each Comparative Example. Moreover, the durability of the golf ball of Comparative Example 11 was 68 and greatly decreased as compared to the durability (100) of Example 1. From the results of evaluation, advantages of the present invention are clear.

The golf ball according to the present invention can be used for, for example, playing golf on golf courses and practicing at driving ranges. The above descriptions are merely illustrative examples, and various modifications can be made without departing from the principles of the present invention.

What is claimed is:

1. A golf ball comprising a spherical core and a cover positioned outside the core, wherein the core has an inner layer and an outer layer positioned outside the inner layer, the inner layer is obtained by crosslinking a rubber composition, the rubber composition of the inner layer includes a butyl-based rubber as a base rubber, wherein the butyl-based rubber is a polymer including an isobutylene unit and an isoprene unit, or a derivative thereof, the inner layer has a diameter Di of not less than 10 mm and not greater than 34 mm, the outer layer surface Shore C hardness H2 is not less than 75 but not greater than 95, and a difference (H2−H0) between the outer layer surface Shore C hardness H2 and the inner layer central point Shore C hardness H0 is less than 35.

2. The golf ball according to claim 1, wherein a proportion of the butyl-based rubber to the entire base rubber is not less than 1% by weight and not greater than 40% by weight.

3. The golf ball according to claim 1, wherein the outer layer is obtained by crosslinking a rubber composition.

4. The golf ball according to claim 1, wherein the outer layer has a thickness To of not less than 4 mm and not greater than 15 mm.

5. The golf ball according to claim 1, wherein the inner layer has a specific gravity di of not less than 1.05 and not greater than 1.20, and the outer layer has a specific gravity do of not less than 1.05 and not greater than 1.20.

6. The golf ball according to claim 1, wherein the hardness H2 is greater than the inner layer surface Shore C hardness H1.

7. The golf ball according to claim 1, further comprising a mid layer between the core and the cover.

8. The golf ball according to claim 1, wherein the inner layer compressive deformation Si is not less than 3.0 mm but not greater than 6.5 mm, and wherein the compressive deformation measurement is obtained from a state of applying an initial load of 98N to a state of applying a final load of 981N.

9. The golf ball according to claim 1, wherein the core compressive deformation Sc is not less than 2.3 min but not greater than 4.0 mm, and wherein the compressive deformation measurement is obtained from a state of applying an initial load of 98N to a state of applying a final load of 1274N.

10. The golf ball according to claim 1, wherein an amount of compressive deformation Sb of the golf ball obtained from a state of applying an initial load of 98N to a state of applying a final load of 1274N is not less than 2.3 mm but not greater than 4.0 mm.

11. The golf ball according to claim 1, wherein a Mooney viscosity (ML1+8, 125° C.) of the butyl-based rubber is not less than 28 but not greater than 60.

12. The golf ball according to claim 1, wherein the rubber composition of the inner layer includes a crosslinking activator, and the amount of the crosslinking activator per 100 parts by weight of the base rubber is not less than 1.0 part by weight but not greater than 20 parts by weight.

13. The golf ball according to claim 1, wherein the outer layer is obtained by crosslinking a rubber composition including a co-crosslinking agent, and the rubber composition of the outer layer includes a carboxylic acid and/or a metal salt thereof in addition to the co-crosslinking agent.

14. The golf ball according to claim 1, wherein the proportion of the isoprene unit in the butyl-based rubber (degree of unsaturation) is not less than 0.6 mol % but not greater than 3.2 mol %.

15. The golf ball according to claim 1, wherein the butyl-based rubber includes a halogenated butyl rubber, and the halogenated butyl rubber halogen content is not less than 0.6% by weight but not greater than 3.0% by weight.

16. The golf ball according to claim 1, wherein the inner layer central point Shore C hardness H0 is not less than 40 but not greater than 65.

17. The golf ball according to claim 1, wherein the inner layer surface Shore C hardness H1 is not less than 65 but not greater than 80.

18. The golf ball according to claim 1, wherein a difference (H1−H0) is not less than 5 but not greater than 20.

19. The golf ball according to claim 1, wherein a difference (H2−H1) is not less than 6 but not greater than 20.

* * * * *